US007399367B2

(12) United States Patent
Okumura et al.

(10) Patent No.: US 7,399,367 B2
(45) Date of Patent: Jul. 15, 2008

(54) RUST-PREVENTIVE WATER-OIL SEPARATING CLEANER COMPOSITION AND A CLEANING METHOD USING THE SAME

(75) Inventors: Kazushi Okumura, Fukui (JP); Hirofumi Tochikawa, Fukui (JP); Masahiro Makino, Fukui (JP); Hideaki Tojo, Tokyo (JP)

(73) Assignees: Nicca Chemical Co., Ltd., Fukui-Shi, Fukui (JP); Honda Motor Co., Ltd., Tokyo (JP)

( * ) Notice: Subject to any disclaimer, the term of this patent is extended or adjusted under 35 U.S.C. 154(b) by 0 days.

(21) Appl. No.: 10/577,877

(22) PCT Filed: Oct. 20, 2004 (Under 37 CFR 1.47)

(86) PCT No.: PCT/JP2004/015520

§ 371 (c)(1), (2), (4) Date: Mar. 8, 2007

(87) PCT Pub. No.: WO2005/044964

PCT Pub. Date: May 19, 2005

(65) Prior Publication Data

US 2007/0173425 A1 Jul. 26, 2007

(30) Foreign Application Priority Data

Nov. 11, 2003 (JP) ..... 2003-381205

(51) Int. Cl.
*B08B 3/00* (2006.01)

(52) U.S. Cl. ..... 134/40; 134/10; 134/13; 134/36; 134/42; 510/363; 510/423; 510/424; 510/433; 510/491

(58) Field of Classification Search ..... 134/10, 134/13, 36, 40, 42; 510/363, 423, 424, 433, 510/491

See application file for complete search history.

(56) References Cited

U.S. PATENT DOCUMENTS

2007/0173425 A1 * 7/2007 Okumura et al. ..... 510/201

FOREIGN PATENT DOCUMENTS

| | | |
|---|---|---|
| EP | 1683853 A1 * | 7/2006 |
| JP | 62-146285 | 6/1987 |
| JP | 05-279695 | 10/1993 |
| JP | 2742384 | 1/1996 |
| JP | 2000-290686 | 10/2000 |
| JP | 3430147 | 6/2002 |
| JP | 2003-119496 | 4/2003 |

OTHER PUBLICATIONS

International Preliminary Report on Patentability for PCT Application No. PCT/JP2004/015520.

* cited by examiner

*Primary Examiner*—Sharidan Carrillo
(74) *Attorney, Agent, or Firm*—Leydig, Voit & Mayer, Ltd.

(57) ABSTRACT

A rust-preventive water-oil separating cleaner composition contacts a part to be cleaned to which an oil attaches. The composition separates the oil from the part, while providing the part with a rust-preventive property, thus forming an oil layer containing the oil. The composition contains an ethylene oxide additive (X) of monoalkyl amine represented by the general formula (1), and at least one compound (Y) selected from the group consisting of: an N-monoalkyl-N-(2-hydroxyalkyl)-iminoethylene carboxylate having a hydrocarbon group with a number of carbon atoms from 8 to 22; an acylated amino acid salt having a hydrocarbon group with a number of carbon atoms from 8 to 22; an alkyloyl sarcosinate having a hydrocarbon group with a number of carbon atoms from 8 to 22, and a tall oil fatty acid salt

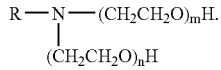

(1)

6 Claims, No Drawings

RUST-PREVENTIVE WATER-OIL SEPARATING CLEANER COMPOSITION AND A CLEANING METHOD USING THE SAME

TECHNICAL FIELD

The present invention relates to a rust-preventive water-oil separating cleaner composition and to a cleaning method using the same.

BACKGROUND ART

On removing oils and the like such as machine oil, rolling oil, and rust-preventive oil attached to machines, mechanical parts, and the like, or on removing oils and the like generated during fiber-processing stage and attached to facilities, there are used in recent years a water-base cleaner consisting mainly of nonionic and anionic surfactant, and a strong-alkali cleaner combining the water-base cleaner with a strong alkali. In case of conventional cleaners which enhance the increased cleaning power and foamability, however, the water-oil separability in the cleaned waste liquid becomes insufficient to apply heavy load to the wastewater treatment, because oils form stable emulsion in the cleaned waste liquid after cleaning or because oils stably become solubilized in the cleaned waste liquid after cleaning. Current serious concern about the environmental problems raises the requirement of reducing the quantity of waste liquid generated from the water-oil separation treatment and of recycling the cleaner. Thus a cleaner having excellent water-oil separability in the cleaned waste liquid is desired.

As the above cleaners, there is disclosed a cleaner composition containing (A) a polyoxyalkylene additive of alkyl amine or alkyl amide, having hydrocarbon group with the number of carbon atoms from 8 to 22, and (B) at least one compound selected from the group consisting of an alkyldimethylamine oxide having hydrocarbon group with the number of carbon atoms from 8 to 22, an alkyl-di (aminomethyl) glycine having hydrocarbon with the number of carbon atoms from 6 to 22, a straight chain sodium dodecylbenzene sulfonate, and betaine lauryldimethyl aminoacetate. Furthermore, there is a disclosed cleaner prepared by mixing the (A) component with the (B) component at a specific mixing rate intending to improve the cleanability, the foamability, and the water-oil separability after cleaning, (for example, see Patent document 1.)

In addition, there is a disclosure of water-oil separating cleaner containing an N-alkyl-N-(2-hydroxyalkyl)-iminoethylene carbonate, (for example, see Patent document 2.)

[Patent document] Japanese Patent Laid-Open No. 2003-119496

[Patent document] Japanese Patent No. 3430147

Regarding the cleaning composition disclosed in Patent. document 1, however, a cleaner composition which uses a polyoxyethylene additive of alkylamine or alkylamide having a polyoxyethylene chain with oxyethylene units from 2 to 50, particularly preferably oxyethylene units from 10 to 50, as the (A) component becomes emulsion by itself to show water-soluble property. Thus, when that type of composition is used to the machines, the mechanical parts, and the like to which oils such as grease, engine oil, machine oil, and rust-preventive oil, (in particular grease-base oil, naphthene-base mineral oil, paraffin-base mineral oil, poly-α-olefin, polyol ester, and polydimethyl siloxane), are attached, the satisfactory cleanability and the water-oil separability in the cleaned waste liquid cannot be attained at the same time, and further a problem of rust-generation on the parts to be cleaned arises during or after cleaning.

As for the use of cleaner disclosed in Patent document 2, the water-oil separability after cleaning is significantly influenced by the temperature of the cleaning liquid. Since, at low temperatures, separation of oil layer from aqueous one takes a long time, the reduction in load to the wastewater treatment is not sufficient. In addition, cleanability and rust-preventive performance are not sufficient.

SUMMARY OF THE INVENTION

The present invention was completed to solve the above-described problems. An object of the present invention is to provide a cleaner composition which removes oils (particularly grease-base oil, naphthene-base mineral oil, paraffin-base mineral oil, poly-α-olefin, polyol ester, and polydimethyl siloxane) from the parts such as machines and mechanical parts to which oils such as machine oil, rolling oil, and rust-preventive oil are attached and from the parts such as facilities to which oils generated from the fiber-processing stage are attached, and the invented cleaner composition is a rust-preventive water-oil separating cleaner composition which not only performs high cleanability, but also suppresses the generation of rust on the parts, and provides excellent water-oil separability of the cleaned waste liquid, particularly excellent water-oil separability at low temperatures. Another object of the present invention is to provide a cleaning method using the rust-preventive water-oil separating cleaner composition and to recycle the cleaning liquid.

DETAILED DESCRIPTION OF THE INVENTION

The inventors of the present invention conducted detailed study for solving the above problems, and found that a cleaner composition which combines a specified amine-base compound with a specified anionic surfactant has strong cleanability, suppresses rust generation on the smeared parts, and shows excellent water-oil separability of the cleaned waste liquid, particularly the water-oil separability at low temperatures. In addition, the inventors of the present invention found that the cleaned waste liquid readily separates the oil layer portion from the aqueous one, and that the oil layer portion can be recovered as the oil component, while the aqueous layer portion can be recycled as the cleaning liquid, thus completed the present invention.

That is, the rust-preventive water-oil separating cleaner composition according to the present invention is a rust-preventive water-oil separating cleaner composition which contacts with the parts to which at least one oil selected from the group consisting of grease-base oil, naphthene-base mineral oil, paraffin-base mineral oil, poly-α-olefin, polyol ester, and polydimethyl siloxane attaches, and separates the oil from the parts, while providing the parts with rust preventive property, thus forming an oil layer containing the oil.

The composition contains (X) an ethylene oxide additive of monoalkyl amine represented by the general formula (1), and (Y) at least one compound selected from the group consisting of: an N-monoalkyl-N-(2-hydroxyalkyl)-iminoethylene carboxylate having hydrocarbon group with the number of carbon atoms from 8 to 22; an acylated amino acid salt having hydrocarbon group with the number of carbon atoms from 8 to 22; an alkyloyl sarcosinate having hydrocarbon group with the number of carbon atoms from 8 to 22, and a tall oil fatty acid salt,

[Chemical Formula 1]

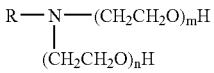

(1)

in the general formula (1), R designates an alkyl group having straight chain or side chain with the number of carbon atoms from 7 to 9, m designates integer from 0 to 2, n designates integer from 0 to 2, and (m+n) designates integer from 1 to 3.

The value of (m+n) in the above general formula (1) is preferably 1 or 2.

The value of R in the above general formula (1) is preferably 2-ethylhexyl group.

The mass ratio of the (X) component to the (Y) component, [(Wx)/(Wy)], is preferably in a range from 3/7 to 7/3.

The cleaning method according to the present invention has the steps of: placing a part to which oil attaches to contact with a cleaning liquid containing any of the above rust-preventive water-oil separating cleaner compositions to separate the oil from the part, while providing the part with rust-preventive property; forming an oil layer containing the oil; and reusing as the cleaning liquid an aqueous layer obtained by removing the oil layer from the cleaning liquid after contacting with the part.

The pH value of the cleaning liquid containing the rust-preventive water-oil separating cleaner composition is preferably adjusted to 7.5 or larger.

Furthermore, the oil may be at least one oil selected from the group consisting of grease-base oil, naphthene-base mineral oil, paraffin-base mineral oil, poly-α-olefin, polyol ester, and polydimethyl siloxane.

According to the present invention, there is provided a rust-preventive water-oil separating cleaner composition which has strong cleanability to remove oils and the like (particularly grease-base oil, naphthene-base mineral oil, paraffin-base mineral oil, poly-α-olefin, polyol ester, and polydimethyl siloxane) attached to the part to be cleaned, suppresses the generation of rust on the part, and further has excellent water-oil separability of the cleaned waste liquid, particularly the water-oil separability at low temperatures. In addition, according to the present invention, there is provided a cleaning method which allows the cleaning liquid containing a rust-preventive water-oil separating cleaner composition to recycle.

The rust-preventive water-oil separating cleaner composition according to the present invention contains (X) an ethylene oxide additive of monoalkyl amine represented by the general formula (1), and (Y) at least one compound selected from the group consisting of: an N-monoalkyl-N-(2-hydroxyalkyl)-iminoethylene carboxylate having hydrocarbon group with the number of carbon atoms from 8 to 22; an acylated amino acid salt having hydrocarbon group with the number of carbon atoms from 8 to 22; an alkyloyl sarcosinate having hydrocarbon group with the number of carbon atoms from 8 to 22, and a tall oil fatty acid salt,

[Chemical Formula 2]

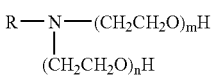

(1)

In the above general formula (1), R designates an alkyl group having straight chain or side chain with the number of carbon atoms from 7 to 9, m designates integer from 0 to 2, n designates integer from 0 to 2, and (m+n) designates integer from 1 to 3.

If the number of carbon atoms in R is 6 or smaller, the solubility of the rust-preventive water-oil separating cleaner composition in water becomes high, and the water-oil separability thereof becomes insufficient. If the number of carbon atoms in R is 10 or larger, the cleanability of the rust-preventive water-oil separating cleaner composition becomes insufficient. From the standpoint of the purposes much surely to attain the cleanability, to provide the part to be cleaned with the rust-preventive performance, and to attain the water-oil separability, the R according to the present invention is preferably 2-ethylhexyl group.

When the value of m or n in the general formula (1) is 3 or more, the solubility of the rust-preventive water-oil separating cleaner composition in water becomes high so that the effect of oil-removal from the part to be cleaned cannot be attained. If the value of (m+n) is 0, that is, if no ethylene oxide is added, the cleaner functions as an oily component so that the effect of cleanability of the rust-preventive water-oil separating cleaner composition cannot be attained. If the value of (m+n) is 4 or larger, the solubility of the rust-preventive water-oil separating cleaner composition in water becomes higher and the effect as the surface active agent lowers, thus the effect of oil-removal from the part can not be attained. Consequently, from the viewpoint of readily and surely attaining the effect of the present invention, the value of (m+n) according to the present invention is preferably 1 or 2.

As the compound of the general formula (1) according to the present invention, for example, N-2-ethylhexyl-N-hydroxyethylamine, N-2-ethylhexyl-N,N-dihydroxyethylamine, and N-2-ethyhexyl-N-hydroxyethyl-N-hydroxyethoxyethylamine can be mentioned.

The (Y) component according to the present invention is at least one compound selected from the group consisting of: an N-monoalkyl-N-(2-hydroxyalkyl)-iminoethylene carboxylate having hydrocarbon group with the number of carbon atoms from 8 to 22; an acylated amino acid salt having hydrocarbon group with the number of carbon atoms from 8 to 22; an alkyloyl sarcosinate having hydrocarbon group with the number of carbon atoms from 8 to 22, and a tall oil fatty acid salt. The hydrocarbon group with the number of carbon atoms from 8 to 22 is a hydrocarbon group having straight chain or branched chain. The (Y) component according to the present invention is preferably soluble in water. By providing the water-soluble property, the effect of the present invention, particularly the water-oil separability, is further surely attained. If the cleaning liquid after the water-oil separation is subjected to a post-treatment, (for example, coagulation treatment), the removal of surface active agent, (Y component), likely becomes easier, and the biodegradability likely attained easily.

Examples of the monoalkyl group in the N-monoalkyl-N-(2-hydroxyalkyl)-iminoethylene carboxylate having hydrocarbon group with the number of carbon atoms from 8 to 22, which is applied to the (Y) component, are 2-ethylhexyl group, decyl group, dodecyl group, tetradecyl group, hexadecyl group, and octadecyl group. Examples of the hydroxyalkyl group therein are hydroxyethyl group and hydroxypropyl group. From the viewpoint of the purpose to attain both the cleanability and the water-oil separability, the N-monoalkyl-N-(2-hydroxyalkyl)-iminoethylene carbonate having hydrocarbon group with the number of carbon atoms from 8 to 22 according to the present invention preferably uses N-2-ethylhexyl-N-(2-hydroxyethyl)-iminoethylene carboxylate, N-decyl-N-(2-hydroxyethyl)-iminoethylene carboxylate, and N-dodecyl-N-(2-hydroxyethyl)-iminoethylene carboxylate.

Examples of the N-monoalkyl-N-(2-hydroxylalkyl)-iminoethylene carboxylate are sodium salt, potassium salt, lithium salt, ammonium salt, and organic amine salt such as monoethanolamine, diethanolamine, triethanolamine, monoisopropanolamine, diisopropanolamine, and triisopropanolamine.

The above N-monoalkyl-N-(2-hydroxyalkyl)-iminoethylene carboxylates having hydrocarbon group with the number of carbon atoms from 8 to 22 may be used in a single or a combination of two or more kinds thereof.

Examples of the acylated amino acid salt having hydrocarbon group with the number of carbon atoms from 8 to 22 in the (Y) component are lauroyl glycinate, lauroyl alanate, lauroyl β-alanate, lauroyl glutamate, myristoyl glycinate, myristoyl alanate, myristoyl β-alanate, myristoyl glutamate, palmitoyl glycinate, palmitoyl alanate, palmitoyl β-alanate, and palmitoyl glutamate. Among them, particularly preferred are lauroyl glycinate, lauroyl alanate, lauroyl β-alanate, and lauroyl glutamate from the viewpoint of the purpose to attain both the cleanability and the water-oil separability.

Examples of the salt of acylated amino acid salt having hydrocarbon group with the number of carbon atoms from 8 to 22 are sodium salt, potassium salt, lithium salt, ammonium salt, and organic amine salt such as monoethanolamine, diethanolamine, triethanolamine, monoisopropanolamine, diisopropanolamine, and triisopropanolamine.

The above acylated amino acid salts having hydrocarbon group with the number of carbon atoms from 8 to 22 may be used in a single or a combination of two or more kinds thereof.

Examples of the alkyloyl sarcosinate having hydrocarbon group with the number of carbon atoms from 8 to 22, which is applied to the (Y) component, are lauroyl sarcosinate, myristoyl sarcosinate, palmitoyl sarcosinate, and oleyl sarcosinate. Among them, lauroyl sarcosinate is preferred to further surely attain the cleanability, the water-oil separability, and the rust-preventiveness.

Examples of the salt of alkyloyl sarcosinate having hydrocarbon group with the number of carbon atoms from 8 to 22 are sodium salt, potassium salt, lithium salt, ammonium salt, and organic amine salt such as monoethanolamine, diethanolamine, triethanolamine, monoisopropanolamine, diisopropanolamine, and triisopropanolamine.

The above alkyloyl sarcosinate having hydrocarbon group with the number of carbon atoms from 8 to 22 may be used in a single or a combination of two or more kinds thereof.

According to the rust-preventive water-oil separating cleaner composition of the present invention, the mass ratio of the (X) component to the (Y) component, [(Wx)/(Wy)], is preferably in a range from 3/7 to 7/3, more preferably from 4/6 to 7/3, and most preferably from 5/5 to 7/3. If the mass ratio [(Wx)/(Wy)] becomes smaller than 3/7, that is, if (X) component decreases, the cleanability tends to lower, though the water-oil separability is improved. If the mass ratio exceeds 7/3, that is, if the (X) component increases, the water-oil separability tends to lower, though the cleanability is improved.

The rust-preventive water-oil separating cleaner composition according to the present invention may further contain known additives applied to ordinary cleaners, such as a chelating agent, a rust-preventive agent, an inorganic builder, an organic builder, and a water-soluble solvent as far as they do not give bad influence on the effect of the present invention.

The rust-preventive water-oil separating cleaner composition according to the present invention may be used without diluting or after diluting to an adequate concentration by a known diluent such as water. According to the present invention, the rust-preventive water-oil separating cleaner composition is preferably diluted by water before use. The rust-preventive water-oil separating cleaner composition can be used after dilution so that the nonvolatile material concentration therein is preferably from 0.1 to 10% by mass, and more preferably the concentration is from 0.3 to 5% by mass.

In case the rust-preventive water-oil separating cleaner composition according to the present invention is used as the cleaning liquid, pH of the cleaning liquid is preferably adjusted to 7.5 or larger, and more preferably to 8.0 or larger. When water is used to dilute the cleaning liquid to the above concentration, pH becomes 8.0 or larger so that the cleaning liquid can be applied without specific pH adjustment.

The rust-preventive water-oil separating cleaner composition according to the present invention can be applied in various fields without specific limitations. For example, the composition is applicable as a cleaner for general machines, mechanical parts and the like, to which machine oil, rolling oil, rust-preventive oil and the like are attached, for fiber-processing machines such as dyeing machine and scouring machine to which oils and the like are attached during fiber-processing stage, for body of vehicles (automobile, electric car, airplane and the like) and for walls and floors inside and outside of buildings to which oils and the like are attached. Furthermore, since cleaned waste liquid has good water-oil separability, the collected aqueous layer portion after separation from the oil layer is not discarded, but can be recycled as the cleaning liquid without any treatment.

The cleaning method according to the present invention has the steps of: placing a part (part to be cleaned) to which oil is attached to contact with the cleaning liquid containing above rust-preventive water-oil separating cleaner composition according to the present invention to separate the oil from the part (part to be cleaned), while providing the part (part to be cleaned) with rust-preventive property; forming an oil layer containing the oil; and reusing an aqueous layer obtained by removing the oil layer from the cleaning liquid after contacting with the part (part to be cleaned), as the cleaning liquid. Specifically the cleaning method according to the present invention is preferably applied to a part to be cleaned to which at least one oil selected from the group consisting of grease-base oil, naphthene-base mineral oil, paraffin-base mineral oil, poly-α-olefin, polyol ester, and polydimethyl siloxane is attached.

Since the cleaning method according to the present invention uses the rust-preventive water-oil separating cleaner composition of the present invention having excellent cleanability, rust-preventiveness, and water-oil separability, the removal of above oils, the suppression of rust-generation on the part (part to be cleaned), and the reduction in the load to the water-oil separation treatment are attained. Furthermore, the cleaning method according to the present invention assembles an excellent cleaning system exerting only a light load to the environment, in which the aqueous layer obtained from the cleaned waste liquid is reused as the cleaner without discarding to environment.

The cleaning method according to the present invention can be applied in various fields without specific limitation. For example, the cleaning method is applicable as the one for general machines, mechanical parts and the like, to which machine oil, rolling oil, and rust-preventive oil are attached, for fiber-processing machines such as dyeing machine and scouring machine to which oils and the like are attached during fiber-processing stage, for body of vehicles (automobile, electric car, airplane and the like) and for walls and floors inside and outside of buildings to which oils and the like are attached.

EXAMPLES

The present invention is described below in more detail referring to the Examples. The present invention, however, is not limited by the Examples.

The ingredients applied to Examples and to Comparative Examples are the compounds described below.

(Compound X-1)

N-2-ethylhexyl-N-hydroxyethylamine prepared by adding 1 mole of ethylene oxide to 1 mole of 2-ethylhexylamine.

(Compound X-2)

N-2-ethylhexyl-N,N-dihydroxyethylamine prepared by adding 2 moles of ethylene oxide to 1 mole of 2-ethylhexylamine.

(Compound X-3)

N-2-ethyhexyl-N-hydroxyethyl-N-hydroxyethoxyethylamine prepared by adding 3 moles of ethylene oxide to 1 mole of 2-ethylhexylamine.

(Compound X-4)

N-2-ethyhexyl-N, N-dihydroxyethoxyethylamine prepared by adding 4 moles of ethylene oxide to 1 mole of 2-ethylhexylamine.

(Compound Y-1)

Sodium salt of N-2-ethylhexyl-N-(2-hydroxyethyl)-iminoethylene carboxylic acid, which is synthesized according to the Example 1 of Japanese Patent No.3430147.

(Compound Y-2)

Acylated amino acid salt (trade name "ATC-12" (Palm oil fatty acid acyl alanine triethanolamine salt), manufactured by Ajinomoto Co., Inc.)

(Compound Y-3)

Alkyloyl sarcosinate (trade name "Soypon SCE" (palm oil fatty acid sodium sarcosinate), manufactured by Kawaken Fine Chemicals Co., Ltd.)

(Compound Y-4)

Tall oil fatty acid salt (prepared by neutralizing "HARTALL 30" (trade name, a mixture of tall oil fatty acid and resin tall oil fatty acid, manufactured by Harima Chemicals, Inc.) by sodium hydroxide).

<Preparation of Rust-preventive Water-oil Separating Cleaner Composition>

Example 1

7 g of N-2-ethylhexyl-N-hydroxyethylamine (Compound X-1), 3 g of sodium salt of N-2-ethylhexyl-N-(2-hydroxyethyl)-iminoethylene carboxylic acid (Compound Y-1), and 90 g of water were mixed and from the homogeneous phase a rust-preventive water-oil separating cleaner composition was obtained.

Example 2

3 g of N-2-ethylhexyl-N,N-dihydroxyethylamine (Compound X-2), 7 g of sodium salt of N-2-ethylhexyl-N-(2-hydroxyethyl)-iminoethylene carboxylic acid (Compound Y-1), and 90 g of water were mixed and from the homogeneous phase a rust-preventive water-oil separating cleaner composition was obtained.

Example 3

5 g of N-2-ethylhexyl-N,N-dihydroxyethylamine (Compound X-2), 5 g of alkyloyl sarcosinate (Compound Y-3), and 90 g of water were mixed and from the homogeneous phase a rust-preventive water-oil separating cleaner composition was obtained.

Example 4

5 g of N-2-ethylhexyl-N,N-dihydroxyethylamine (Compound X-2), 5 g of tall oil fatty acid salt (Compound Y-4), and 90 g of water were mixed and from the homogeneous phase a rust-preventive water-oil separating cleaner composition was obtained.

Example 5

7 g of N-2-ethylhexyl-N,N-dihydroxyethylamine (Compound X-2), 3 g of acylated amino acid salt(Compound Y-2), and 90 g of water were mixed and from the homogeneous phase a rust-preventive water-oil separating cleaner composition was obtained.

Example 6

5 g of N-2-ethylhexyl-N,N-dihydroxyethylamine (Compound X-2), 1 g of acylated amino acid salt (Compound Y-2), 1 g of alkyloyl sarcosinate (Compound Y-3), 3 g of tall oil fatty acid salt (Compound Y-4), and 90 g of water were mixed and from the homogeneous phase a rust-preventive water-oil separating cleaner composition was obtained.

Example 7

5 g of N-2-ethylhexyl-N,N-dihydroxyethylamine (Compound X-2), 1 g of sodium salt of N-2-ethylhexyl-N-(2-hydroxyethyl)-iminoethylene carboxylic acid (Compound Y-,1), 1 g of acylated amino acid salt (Compound Y-2), 1 g of alkyloyl sarcosinate (Compound Y-3), 2 g of tall oil fatty acid salt (Compound Y-4), and 90 g of water were mixed and from the homogeneous phase a rust-preventive water-oil separating cleaner composition was obtained.

Example 8

7 g of N-2-ethylhexyl-N-hydroxyethyl-N-hydroxyethoxyethylamine (Compound X-3), 3 g of alkyloyl sarcosinate (Compound Y-3), and 90 g of water were mixed and from the homogeneous phase a rust-preventive water-oil separating cleaner composition was obtained.

Example 9

5 g of N-2-ethylhexyl-N-hydroxyethyl-N-hydroxyethoxyethylamine (Compound X-3), 1 g of sodium salt of N-2-ethylhexyl-N-(2-hydroxyethyl)-iminoethylene carboxylic acid (Compound Y-1), 1 g of alkyloyl sarcosinate (Compound Y-3), 3 g of tall oil fatty acid salt (Compound Y-4), and 90 g of water were mixed and from the homogeneous phase a rust-preventive water-oil separating cleaner composition was obtained.

Comparative Example 1

10 g of sodium salt of N-2-ethylhexyl-N-(2-hydroxyethyl)-iminoethylene carboxylic acid (Compound Y-1) and 90 g of water were mixed and from the homogeneous phase a rust-preventive water-oil separating cleaner composition was obtained.

Comparative Example 2

10 g of acylated amino acid salt (Compound Y-2) and 90 g of water were mixed and from the homogeneous phase a rust-preventive water-oil separating cleaner composition was obtained.

Comparative Example 3

10 g of alkyloyl sarcosinate (Compound Y-3) and 90 g of water were mixed and from the homogeneous phase a rust-preventive water-oil separating cleaner composition was obtained.

Comparative Example 4

10 g of tall oil fatty acid salt (Compound Y-4) and 90 g of water were mixed and from the homogeneous phase a rust-preventive water-oil separating cleaner composition was obtained.

Comparative Example 5

10 g of N-2-ethylhexyl-N-hydroxyethylamine (Compound X-1) and 90 g of water were mixed and from the homogeneous phase a rust-preventive water-oil separating cleaner composition was obtained.

Comparative Example 6

10 g of N-2-ethylhexyl-N,N-dihydroxyethylamine (Compound X-2) and 90 g of water were mixed and from the homogeneous phase a rust-preventive water-oil separating cleaner composition was obtained.

Comparative Example 7

10 g of N-2-ethylhexyl-N-hydroxyethyl-N-hydroxyethoxyethylamine (Compound X-3) and 90 g of water were mixed and from the homogeneous phase a rust-preventive water-oil separating cleaner composition was obtained.

Comparative Example 8

10 g of N-2-ethylhexyl-N,N-dihydroxyethoxyethylamine (Compound X-4) and 90 g of water were mixed and from the homogeneous phase a rust-preventive water-oil separating cleaner composition was obtained.

The prepared rust-preventive water-oil separating cleaner compositions of Examples 1-9 and Comparative Examples 1-8 were evaluated by the cleanability test, the water-oil separability test, and the rust-prevention test. The methods for testing are described below.

1. Cleanability Test

A sheet of SPCC-SB rolled steel sheet, (60 mm×80 mm×1.2 mm), was washed alternately two times by toluene and acetone, and then dried in air. The mass of the air-dried steel sheet, (W1), was determined. 0.1 g of mixed oil given below was smeared on the steel sheet, which was then subjected to a heat treatment by heating to 110° C. for 10 minutes, followed by cooling to room temperature (about 20° C.) in a desiccator. The mass of the cooled steel sheet, (W2), was determined. Afterwards, the steel sheet was immersed into 300 ml of aqueous solution (cleaning liquid) of 1% by mass (nonvolatile material equivalent) of the prepared rust-preventive water-oil separating cleaner composition for 10 minutes under stirring (60 rpm) at 20° C. and washed. After that, the steel sheet was rinsed in water stream for 30 seconds. After drying at 105° C. for 5 minutes, the rinsed steel sheet was cooled to room temperature in a desiccator. Then, the mass of the steel sheet, (W3), was determined. The cleaning percentage (%) was calculated by the formula (2) to evaluate the cleanability. The result is shown in Table 1 and Table 2.

$$\text{Cleaning percentage (\%)}=(W2-W3)\times 100/(W2-W1) \quad (2)$$

[Mixed Oil]

Gasoline engine oil (waste oil), diesel engine oil (waste oil), and grease (trade name "BANNOU GREASE" (for high speed bearings), manufactured by AZ Co., Ltd.) were mixed at a mass ratio of 50/50/20.

2. Water-oil Separability Test 80 ml of an aqueous solution (cleaning liquid) of 1% by mass (nonvolatile material equivalent) of the prepared rust-preventive water-oil separating cleaner composition and 20 ml of above mixed oil were poured in a 100 ml graduated cylinder. The cylinder was vigorously shaken 50 times in a vertical distance of 10 cm, and then was allowed for standing at low temperature (12±1° C). After 3 hours, the separation of the aqueous layer from the oil layer was observed to give 5 ranks according to the judgment criterion specified below. Larger number of ranks indicates better water-oil separability, and smaller one of ranks indicates stronger emulsifying and solubilizing state giving poorer water-oil separability. The result is given in Tables 1 and 2.

[Judgment Criterion of Water-oil Separability]

Rank 5: 80 to 70 ml of aqueous layer volume
Rank 4: 69 to 50 ml of aqueous layer volume
Rank 3: 49 to 30 ml of aqueous layer volume
Rank 2: 29 to 10 ml of aqueous layer volume
Rank 1: 9 ml or less of aqueous layer volume 3. Rust-prevention Test A sheet of SPCC-SB rolled steel sheet, (60 mm×80 mm×1.2 mm), as the specimen, was washed alternately two times by toluene and acetone and then dried in air. The specimen was immersed by half length thereof into an aqueous solution (cleaning liquid) of 1% by mass (nonvolatile material equivalent) of the prepared rust-preventive water-oil separating cleaner composition at room temperature (about 20° C). After 48 hours, the existence of the rust was examined by visual observation. The results are given in Tables 1 and 2, and "Effective" means absence of rust-generation, and "Ineffective" presence of rust-generation.

TABLE 1

| | | Example 1 | Example 2 | Example 3 | Example 4 | Example 5 | Example 6 | Example 7 | Example 8 | Example 9 |
|---|---|---|---|---|---|---|---|---|---|---|
| (X) component | X-1 | 7 | — | — | — | — | — | — | — | — |
| (g) | X-2 | — | 3 | 5 | 5 | 7 | 5 | 5 | — | — |
| | X-3 | — | — | — | — | — | — | — | 7 | 5 |
| | X-4 | — | — | — | — | — | — | — | — | — |

TABLE 1-continued

| | | Example 1 | Example 2 | Example 3 | Example 4 | Example 5 | Example 6 | Example 7 | Example 8 | Example 9 |
|---|---|---|---|---|---|---|---|---|---|---|
| (Y) component (g) | Y-1 | 3 | 7 | — | — | — | — | 1 | — | 1 |
| | Y-2 | — | — | — | — | 3 | 1 | 1 | — | — |
| | Y-3 | — | — | 5 | — | — | 1 | 1 | 3 | 1 |
| | Y-4 | — | — | — | 5 | — | 3 | 2 | — | 3 |
| Water (g) | | 90 | 90 | 90 | 90 | 90 | 90 | 90 | 90 | 90 |
| Total (g) | | 100 | 100 | 100 | 100 | 100 | 100 | 100 | 100 | 100 |
| Cleaning percentage (%) | | 95 | 95 | 90 | 90 | 90 | 85 | 90 | 80 | 80 |
| Water-oil separability | | Rank 5 | Rank 5 | Rank 5 | Rank 5 | Rank 5 | Rank 5 | Rank 5 | Rank 5 | Rank 5 |
| Rust-preventiveness | | Effective | Effective | Effective | Effective | Effective | Effective | Effective | Effective | Effective |

The symbol "—" in the table designates absence of the component.

TABLE 2

| | | Comparative Example 1 | Comparative Example 2 | Comparative Example 3 | Comparative Example 4 | Comparative Example 5 | Comparative Example 6 | Comparative Example 7 | Comparative Example 8 |
|---|---|---|---|---|---|---|---|---|---|
| (X) component (g) | X-1 | — | — | — | — | 10 | — | — | — |
| | X-2 | — | — | — | — | — | 10 | — | — |
| | X-3 | — | — | — | — | — | — | 10 | — |
| | X-4 | — | — | — | — | — | — | — | 10 |
| (Y) component (g) | Y-1 | 10 | — | — | — | — | — | — | — |
| | Y-2 | — | 10 | — | — | — | — | — | — |
| | Y-3 | — | — | 10 | — | — | — | — | — |
| | Y-4 | — | — | — | 10 | — | — | — | — |
| Water (g) | | 90 | 90 | 90 | 90 | 90 | 90 | 90 | 90 |
| Total (g) | | 100 | 100 | 100 | 100 | 100 | 100 | 100 | 100 |
| Cleaning percentage (%) | | 50 | 20 | 20 | 20 | 70 | 60 | 40 | 40 |
| Water-oil separability | | Rank 5 | Rank 5 | Rank 5 | Rank 5 | Rank 4 | Rank 3 | Rank 2 | Rank 2 |
| Rust-preventiveness | | Ineffective | Ineffective | Effective | Ineffective | Effective | Effective | Effective | Effective |

The symbol "—" in the table designates absence of the component.

As seen in Table 1, Examples 1-9 gave as high as 80% or more of cleaning percentage, and had rust-preventiveness, and showed excellent water-oil separability at low temperatures. On the other hand, Comparative Examples 1-4 which did not contain the ethylene oxide additive of monoalkylamine, represented by the general formula (1), gave insufficient cleanability. Comparative Examples 1, 2, and 4 showed rust-generation. Comparative Examples 6 and 7 which did not contain the above (Y) component, and Comparative Example 8 which. did not contain the (Y) component and which used the N-2-ethylhexyl-N,N-dihydroxyethoxyethylamine with the value of (m+n) of 4 in the above general formula (1) showed insufficient cleaning percentage and insufficient water-oil separability.

The rust-preventive water-oil separating cleaner composition according to the present invention is applicable in cleaning to remove efficiently oils from machines, mechanical parts, fiber-processing machines, body of vehicles (automobile, electric car, airplane and the like), and walls and floors of inside and outside of buildings to which oils are attached. The cleaning method according to the present invention is applicable to a cleaning system which exerts only a light load to environment.

The invention claimed is:

1. A rust-preventive water-oil separating cleaner composition for contacting a part to be cleaned to which at least one oil selected from the group consisting of grease-based oil, naphthene-based mineral oil, paraffin-based mineral oil, poly-α-olefin, polyol ester, and polydimethyl siloxane attaches, the composition separating the oil from the part, while providing the part with a rust-preventive property, thus forming an oil layer containing the oil, the composition comprising:

(X) an ethylene oxide additive of monoalkyl amine represented by formula (1), and (Y) at least one compound selected from the group consisting of;

an N-monoalkyl-N-(2-hydroxyalkyl)-iminoethylene carboxylate having a hydrocarbon group with a number of carbon atoms from 8 to 22; an acylated amino acid salt having a hydrocarbon group with a number of carbon atoms from 8 to 22; an alkyloyl sarcosinate having a hydrocarbon group with a number of carbon atoms from 8 to 22, and a tall oil fatty acid salt,

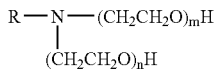

(1)

wherein R designates an alkyl group having a straight chain or a side chain with a number of carbon atoms from 7 to 9, m designates an integer from 0 to 2, n designates an integer from 0 to 2, and (m+n) designates an integer from 1 to 3.

2. The rust-preventive water-oil separating cleaner composition according to claim 1, wherein (m+n) is an integer of 1 or 2.

3. The rust-preventive water-oil separating cleaner composition according to claim 1, wherein R is a 2-ethylhexyl group.

4. The rust-preventive water-oil separating cleaner composition according to claim 1, wherein the said (X) and said (Y) have a mass ratio [(Wx)/(Wy)] in a range from 3/7 to 7/3.

5. A cleaning method comprising:

placing a part to be cleaned to which oil is attached in contact with a cleaning liquid containing the rust-preventive water-oil separating cleaner composition according to claim 1:

separating the oil from the part, while providing the part with a rust-preventive property;

forming an oil layer containing the oil; and reusing an aqueous layer as the cleaning liquid, wherein the aqueous layer is obtained by removing the oil layer from the cleaning liquid after contact with the part.

6. The cleaning method according to claim 5, wherein the cleaning liquid has a pH, and the pH of the cleaning liquid containing the rust-preventive water-oil separating cleaner composition is adjusted to 7.5 or higher.

* * * * *